United States Patent [19]

Schweingruber

[11] 4,395,821

[45] Aug. 2, 1983

[54] DEVICE HAVING A LONG-HAIR CUTTING UNIT

[75] Inventor: Otto Schweingruber, Glash/ tten, Fed. Rep. of Germany

[73] Assignee: Braun Aktiengesellschaft, Kronberg, Fed. Rep. of Germany

[21] Appl. No.: 292,863

[22] Filed: Aug. 14, 1981

[30] Foreign Application Priority Data

Aug. 23, 1980 [DE] Fed. Rep. of Germany ..... 3031918

[51] Int. Cl.[3] ..... B26B 19/28

[52] U.S. Cl. ..... 30/34.1; 30/218

[58] Field of Search ..... 30/34.1, 43.92, 219, 30/220, 221, 218

[56] References Cited

U.S. PATENT DOCUMENTS

| | | | |
|---|---|---|---|
| 3,714,711 | 2/1973 | Daniels | 30/43.92 |
| 3,903,597 | 9/1975 | Cobarg | 30/219 X |
| 4,065,977 | 1/1978 | Buzzi | 30/43.92 |

FOREIGN PATENT DOCUMENTS

| | | | |
|---|---|---|---|
| 7723157 | 11/1977 | Fed. Rep. of Germany . | |
| 2816713 | 10/1979 | Fed. Rep. of Germany | 30/220 |

*Primary Examiner*—Jimmy C. Peters

*Attorney, Agent, or Firm*—Raymond J. De Vellis

[57] ABSTRACT

A long-hair cutter unit associated with a device, such as an electric shaver, includes a lever which translates rotary oscillators to line motion of a slide member. The slide member is connected to a movable cutter part. The lever is preferably integrally formed with the slide member and includes an arm portion having first and second hinge portions.

3 Claims, 2 Drawing Figures

DEVICE HAVING A LONG-HAIR CUTTING UNIT

FIELD OF THE INVENTION

This invention concerns a device, such as an electric shaver, having a long-hair cutting unit. The long-hair cutter unit transfers the driving motion of a lever to translate rotary oscillations to a slide that is conducted linearly in the same plane of motion. The slide supports a cutting part which moves back and forth.

BACKGROUND OF THE INVENTION

In a known device of this type (DE-GM No. 77 23 157), the end of a lever away from a drive is provided with a slotted head which engages a prong that is directly or indirectly connected with a cutting part that moves back and forth. This drive connection has been customary for a long time in several variants, but has several disadvantages. The design of the lever head and of the prong requires relatively high precision, to avoid rattling noises and their associated wear. On the other hand, frictional energy is consumed through the relative motion between the head and the prong, and the springy engagement between these two components can lead to amplitude losses of the moving cutting part. Finally, because of relatively unfavorable bearing and driving conditions, the moved cutting part, or the slide which supports it, tend to produce staggering motions and to the running noises consequent therefrom.

SUMMARY OF THE INVENTION

It is an object of this invention to provide a device having a long-hair cutter unit, which does not have external friction, where rattling and running noises are avoided, and where no amplitude losses arise.

Briefly stated, and according to an aspect of this invention, a device having a long-hair cutter is provided which includes a lever which translates rotary oscillators to linear motion of a slide, which is connected to a cutting part. The lever includes an arm portion having first and second hinge portions. To assure quiet motion and to stress the hinge portions or film hinge-joints as little as possible, the arm portion is directed approximately tangential to the path of motion of the hinge on the lever side and approximately parallel to the path of motion of the hinge on the slide side. The arm portion is affixed in a recess so that the hinge on the slide side, viewed from the fulcrum of the lever, lies on the far side of the guide of the slide. This results in tight dimensions, and prevents staggering motions on the part of the slide. For simple assembly, the module consisting of the lever, the arm portion, and the slide is suitably manufactured in one piece and of a plastic with limited flexibility, and the joints are designed as film hinge-joints.

BRIEF DESCRIPTION OF THE DRAWINGS

The invention both as to its organization and principles of operation, together with further objects and advantages thereof, may better be understood by referring to the following detailed description of an embodiment of the invention taken in conjunction with the accompanying drawing in which.

DETAILED DESCRIPTION

Figure 1:
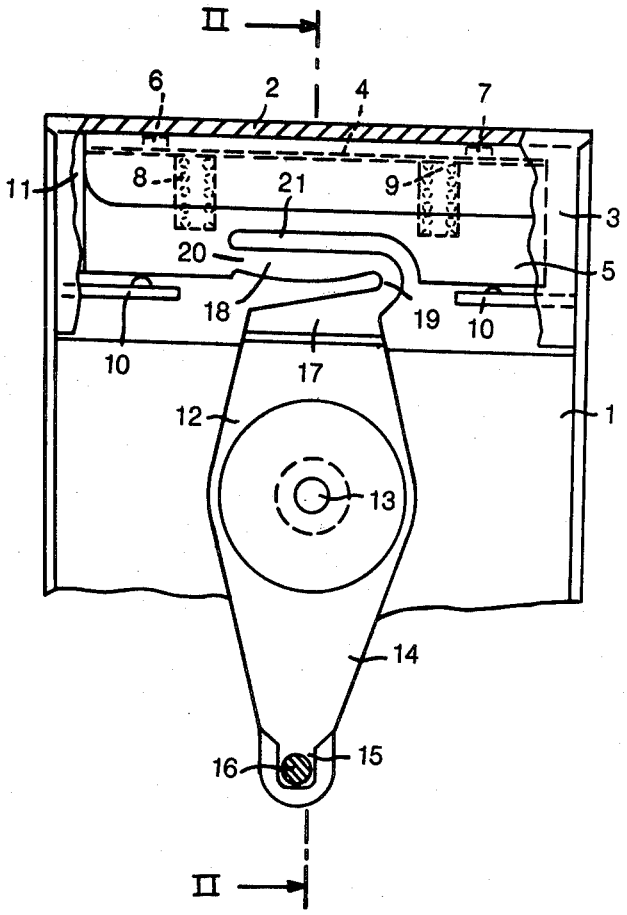
FIG. 1 is a front view of the device, in accordance with this invention.
Figure 2:
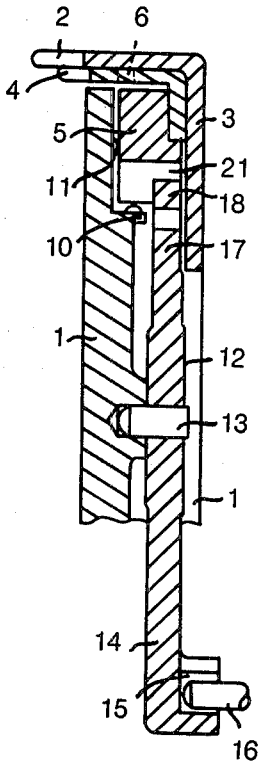
FIG. 2 is a view along the line II—II in FIG. 1, in accordance with this invention.

Referring to FIGS. 1 and 2, a stationary cutting part 2 is mounted on a housing wall 1 of a long-hair cutting unit by means of an angled plate 3.

A movable cutting part 4 is affixed to a slide 5 that moves back and forth and is held in its position by means of bolts 6 and 7. Coil springs 8 and 9 are supported on the slide 5 and press the movable cutting part 4 against the stationary cutting part 2. The slide 5 is guided linearly so that it can slide on a ledge 10 and along a vertical surface 11 of the housing wall 1. On the housing wall 1, a double-armed lever 12 is pivotably mounted on a bolt 13, to drive the slide 5. At a lower end 14, the lever 12 supports a pan member 15. A driving pin 16 of a motor (not shown) typically associated with a device such as an electric shaver and well known in the art, reaches into this pan member 15 with a back-and-forth driving motion (rotary oscillation). At an upper end 17, the lever 12 is connected to the slide 5 through an arm portion 18. Joints or hinge portions 19 and 20 at either side of the arm portion 18 are designed as film hinges. The arm portion 18 is affixed in a recess 21 of the slide 5 in such a fashion that the hinge 20 on the slide side, as viewed from the fulcrum (bolt 13), lies on the far side of the guide of the slide 5 on the ledge 10, as can be seen from FIG. 1, so that the slide 5 is urged towards the ledge 10 during its linear-motion.

Furthermore, the arm portion 18 is directed about tangentially to the path of motion of the hinge portion 19 on the lever side and approximately parallel to the path of motion of the hinge portion 20 on the slide side. The slide 5, the arm portion 18, and the lever 12 are preferably manufactured as one unit from plastic.

While an embodiment and application of the invention has been shown and described, it will be apparent to those skilled in the art that more modifications are possible without departing from the inventive concepts herein described. The invention, therefore, is not to be restricted except as is necessary by the prior art and the spirit of the appended claims.

I claim:

1. A long-hair cutting unit associated with a device for providing rotary oscillations comprising:
   - a housing;
   - a stationary cutter part mounted to said housing;
   - a slide member positioned in said housing and capable of lateral movement therein;
   - a movable cutter part cooperating with said stationary cutter part and affixed to said slide member for movement therewith; and
   - a lever having a first and second end portion pivotably mounted on said housing, said second end portion being adapted to be driven by the rotary oscillation from the associated device, said first end of said lever including an arm portion connected to said slide member at a first hinge portion and connected to said first end of said lever through a second hinge portion, said lever being capable of translating the rotary oscillation to the lateral movement of said slide member in the same plane of motion, and wherein said lever, said arm portion, and said slide member are integrally formed and wherein said first and second hinge portions are flexible.

2. The device according to claim 1 wherein said arm portion is directed approximately tangentially to the path of motion of said second hinge portion and approximately parallel to the path of motion of said first hinge portion.

3. A device according to claim 2 wherein said slide member includes a recess and is mounted on a ledge in said housing and said arm portion being affixed in said recess of said slide so that said first hinge portion, as viewed from the pivot point of said lever lies on the far side of said ledge for said slide.

* * * * *